US011412589B2

(12) United States Patent
Cao et al.

(10) Patent No.: US 11,412,589 B2
(45) Date of Patent: Aug. 9, 2022

(54) DIMMABLE LIGHTING APPARATUS

(71) Applicant: CH LIGHTING TECHNOLOGY CO., LTD., Shaoxing (CN)

(72) Inventors: Shengjun Cao, Shaoxing (CN); Jizhong Pu, Shaoxing (CN)

(73) Assignee: CH LIGHTING TECHNOLOGY CO., LTD., Shaoxing (CN)

( * ) Notice: Subject to any disclaimer, the term of this patent is extended or adjusted under 35 U.S.C. 154(b) by 0 days.

(21) Appl. No.: 17/359,662

(22) Filed: Jun. 28, 2021

(65) Prior Publication Data

US 2022/0030679 A1 Jan. 27, 2022

Related U.S. Application Data

(63) Continuation of application No. PCT/CN2020/137390, filed on Dec. 17, 2020.

(30) Foreign Application Priority Data

Jul. 27, 2020 (CN) ..... 202021510329.X
Nov. 13, 2020 (CN) ..... 202022632834.8

(51) Int. Cl.
*H05B 45/10* (2020.01)
*H05B 45/37* (2020.01)
*H05B 45/345* (2020.01)

(52) U.S. Cl.
CPC ..... *H05B 45/10* (2020.01); *H05B 45/345* (2020.01); *H05B 45/37* (2020.01)

(58) Field of Classification Search
CPC ..... H05B 45/10; H05B 45/345; H05B 45/37
See application file for complete search history.

(56) References Cited

U.S. PATENT DOCUMENTS

2014/0354176 A1 12/2014 Chen
2019/0052176 A1* 2/2019 Yabuzaki ..... H05B 45/14
2019/0268069 A1* 8/2019 Nishino ..... H05B 45/375
2020/0100348 A1* 3/2020 Xiong ..... H05B 45/10

FOREIGN PATENT DOCUMENTS

CN 203661346 U 6/2014

OTHER PUBLICATIONS

International Search Report issued in corresponding International application No. PCT/CN2020/137390, dated Apr. 27, 2021.
Written Opinion of the International Searching Authority for No. PCT/CN2020/137390.

* cited by examiner

*Primary Examiner* — Minh D A

(57) ABSTRACT

The invention provides a dimmable lighting apparatus, comprising a lamp body, and a driving circuit and a light emitting circuit in the lamp body. The driving circuit is configured to drive the light emitting circuit to emit light, and the driving circuit includes an input sub-circuit coupled to a mains and a dimming sub-circuit coupled to an external dimmer, the input sub-circuit, and the light emitting circuit. In particular, the input sub-circuit is grounded in a pre-stage manner, and the dimming sub-circuit is grounded in a post-stage manner.

13 Claims, 3 Drawing Sheets

DIMMABLE LIGHTING APPARATUS

TECHNICAL FIELD

Embodiments of the present invention relate to the field of lighting, and in particular to dimmable lighting apparatus.

BACKGROUND

Led lighting is widely used in various industries, with advantages of long life and high efficiency. With the development of lighting technology and the increasing requirement for energy saving and environmental protection, the demand for a dimmable LED lamp is increasing.

The output power of the LED lamp is generally controlled by adjusting the driving power of the LED lamp, thereby achieving the purpose of dimming. However, most of the driving circuits for the driving power of the LED lamp are not electrically isolated at the input terminal and the load terminal thereof, which is detrimental to the stability and reliability of the dimming circuit, and causes a risk of electric shock to the operators, with poor security. Although a few driving circuits can achieve the electrical isolation function by providing an isolation unit, such an isolation unit generally includes a plurality of devices, which increases the production cost of the LED lamp.

SUMMARY

In view of the problems of the prior art, embodiments of the present invention provide an improved dimmable lighting apparatus to eliminate or at least alleviate at least a part of the deficiencies of the prior art.

In an exemplary embodiment of the present invention, a dimmable lighting apparatus is provided, comprising a lamp body, and a driving circuit and a light emitting circuit in the lamp body. The driving circuit is configured to drive the light emitting circuit to emit light, and the driving circuit includes an input sub-circuit coupled to a mains and a dimming sub-circuit coupled to an external dimmer, the input sub-circuit, and the light emitting circuit. In particular, the input sub-circuit is grounded in a pre-stage manner, and the dimming sub-circuit is grounded in a post-stage manner.

According to an exemplary embodiment of the present invention, the dimming sub-circuit comprises a constant current module coupled to the light emitting circuit, and a dimming module coupled between the constant current module and the external dimmer.

According to an exemplary embodiment of the present invention, the dimming module comprises a voltage dividing unit having a dimming input terminal coupled to the external dimmer, and a sampling output terminal coupled to the constant current module.

According to an exemplary embodiment of the present invention, the voltage dividing unit comprises a first resistor, a second resistor, and a third resistor, wherein a first terminal of the first resistor is coupled to the input sub-circuit, a second terminal of the first resistor is coupled to a first terminal of the second resistor, a second terminal of the second resistor is coupled to the sampling output terminal and a first terminal of the third resistor, and a second terminal of the third resistor is grounded in a post-stage manner.

According to an exemplary embodiment of the present invention, the dimming module further comprises a filtering unit coupled between the voltage dividing unit and the external dimmer.

According to an exemplary embodiment of the present invention, the dimming module comprises a positive input terminal and a negative input terminal coupled to the external dimmer, the filtering unit comprises a first capacitor coupled between the positive input terminal and the negative input terminal, a fourth resistor, a fifth resistor, a second capacitor, and a first diode connected in series between the positive input terminal and the negative input terminal, wherein the sampling output terminal is grounded in a post-stage manner through the second capacitor, and the negative input terminal is grounded in a post-stage manner through the first diode.

According to an exemplary embodiment of the present invention, the dimming module comprises a voltage limiting unit configured to prevent a voltage input from the external dimmer to the constant current module from exceeding a threshold.

According to an exemplary embodiment of the present invention, the constant current module comprises a switch unit, a control unit, and an energy storage and freewheeling unit coupled between the control unit and the light emitting circuit, wherein the control unit is configured to control on/off of the switch unit to control an output power of the constant current module.

According to an exemplary embodiment of the present invention, the switch unit comprises a power MOS transistor being integrated in the control unit.

According to an exemplary embodiment of the present invention, the input sub-circuit comprises a filtering module coupled to the mains and a rectifier module coupled between the filtering module and the dimming sub-circuit, wherein the filtering module is configured to filter a mains signal, and the rectifier module is configured to rectify the filtered mains signal.

According to an exemplary embodiment of the present invention, the rectifier module comprises a bridge rectifying unit, a varistor and a third capacitor, wherein a first input terminal of the bridge rectifying unit is grounded in a pre-stage manner, an output terminal of the bridge rectifying unit is grounded in a pre-stage manner through the varistor and the third capacitor that are connected in parallel.

According to an exemplary embodiment of the present invention, the filtering module comprises a sixth resistor, a fourth capacitor, and a filtering inductor, wherein the filtering inductor and the sixth resistor are connected in parallel between a second input terminal of the bridge rectifying unit and a first terminal of the fourth capacitor, and a second terminal of the fourth capacitor is coupled to a third input terminal of the bridge rectifying unit.

According to an exemplary embodiment of the present invention, the input sub-circuit further comprises a voltage stabilizing module coupled between the rectifier module and the dimming sub-circuit, and the voltage stabilizing module is configured to stabilize a signal input to the dimming sub-circuit.

According to an exemplary embodiment of the present invention, the lighting apparatus is an LED lamp.

According to an exemplary embodiment of the present invention, the LED lamp further comprises end caps located at two ends of the lamp body, and each of the end caps is provided with pins.

It should be understood that the above general description and the following detailed description are only exemplary and explanatory and are not intended to limit the invention in any way.

BRIEF DESCRIPTION OF THE DRAWINGS

The above and further aspects of the invention will be described in more detail with reference to the accompanying drawings, which illustrate embodiments of the invention, but are not necessarily drawn to scale, and should be focused on the illustrated principles of the invention, in which, FIG. 1 schematically illustrates a block diagram of a lighting apparatus according to an exemplary embodiment of the present invention;

FIGS. 2A-2D schematically illustrate circuit diagrams of a lighting apparatus according to an exemplary embodiment of the present invention, wherein FIG. 2A illustrates a circuit diagram of a rectifier module and a filtering module, FIG. 2B illustrates a circuit diagram of a voltage stabilizing module, FIG. 2C illustrates a circuit diagram of a constant current module, and FIG. 2D illustrates a circuit diagram of a dimming module.

The same reference numeral throughout the drawings refers to the same part.

Some embodiments of the present invention have been illustrated through the above drawings, which will be described in more detail hereinafter. These drawings and the related description are not intended to limit the scope of the inventive concept in any manner, but to explain the inventive concept for those skilled in the art with reference to specific embodiments.

DESCRIPTION OF THE EMBODIMENTS

In order to make the purposes, technical solutions and advantages of the embodiments of the present invention more clear, the technical solutions of the embodiments of the present invention will be described clearly and completely with reference to the drawings of the embodiments of the present invention. It will be apparent that the described embodiments are some, but not all, embodiments of the present invention. Based on the described embodiments of the present invention, all other embodiments obtained by those skilled in the art without creative labour fall within the scope of protection of the present invention.

Figure 1:
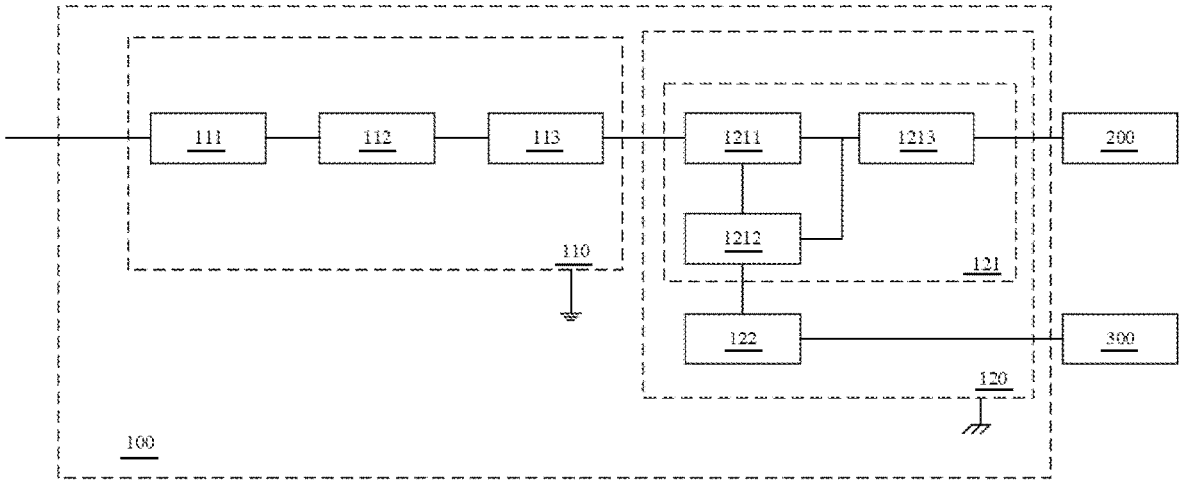
Figure 2A:
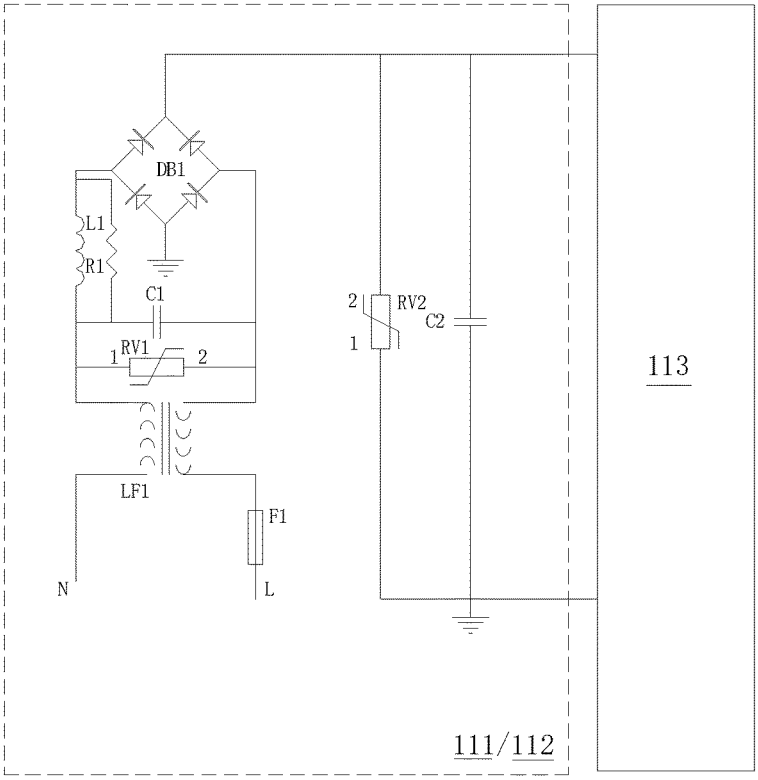
Figure 2B:
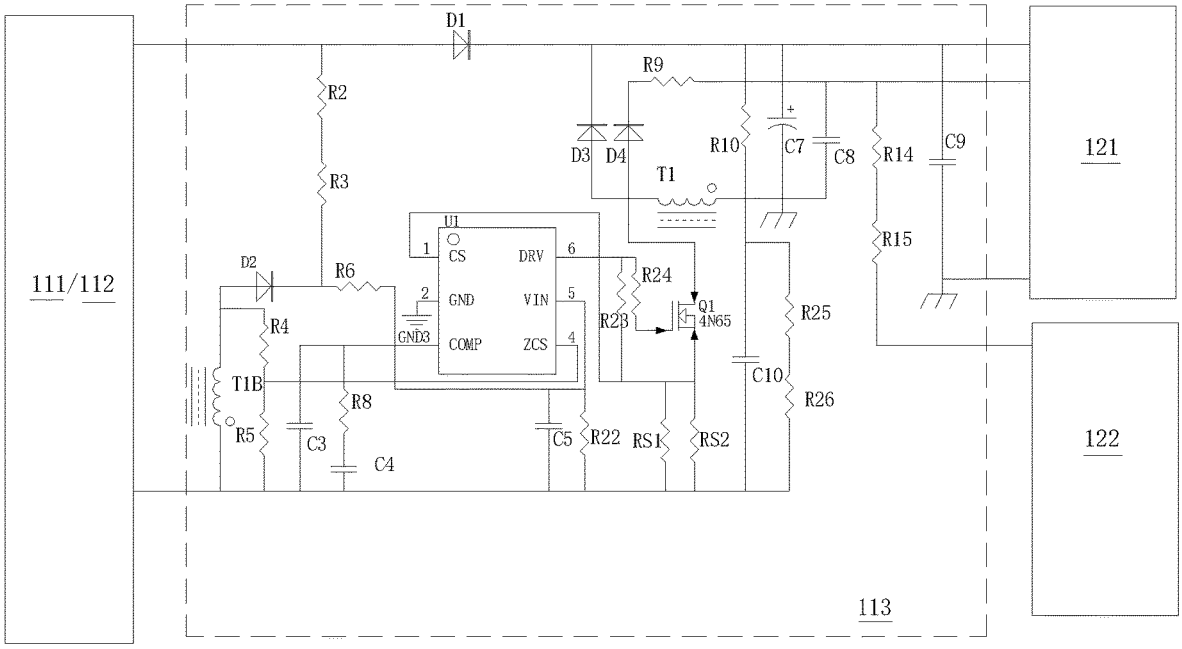
Figure 2C:
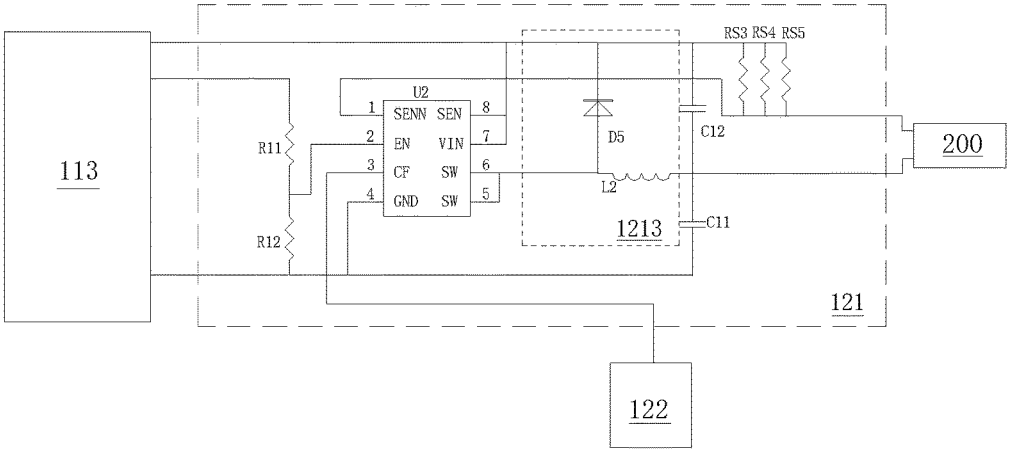
Figure 2D:
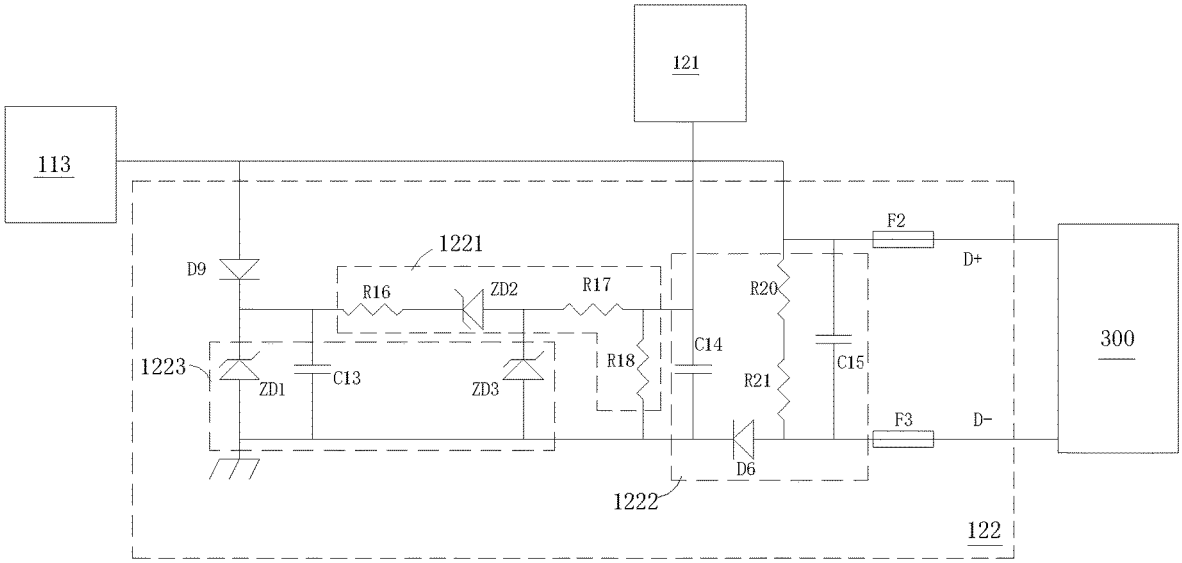

FIG. 1 schematically illustrates a dimmable lighting apparatus according to an exemplary embodiment of the present invention. The lighting apparatus includes a lamp body, a driving circuit 100 and a light emitting circuit 200 in the lamp body. The driving circuit 100 is configured to drive the light emitting circuit 200 to emit light. As shown in FIG. 1, the driving circuit 100 includes an input sub-circuit 110 coupled to the mains and a dimming sub-circuit 120 coupled to an external dimmer 300, the input sub-circuit 110, and the light emitting circuit 200. In particular, the input sub-circuit 110 employs a pre-stage ground, and the dimming sub-circuit 120 employs a post-stage ground.

In the above embodiment, the grounding mode of the input sub-circuit is the pre-stage grounding, i.e., power grounding, and the grounding mode of the dimming sub-circuit is the post-stage grounding, i.e., earth grounding. By providing the input sub-circuit and the dimming sub-circuit with different grounding modes, a good electrical isolation can be achieved between the input terminal and the load terminal, without additional isolation components and manufacturing cost, thereby ensuring the stability and reliability of the dimming circuit, as well as the safety of the driving circuit of the lighting apparatus.

In an exemplary embodiment, the external dimmer 300 may be a linear dimmer with a dimming range from 0 to 10 volts.

In an exemplary embodiment, as shown in FIG. 1, the dimming sub-circuit 120 includes a constant current module 121 coupled to the light emitting circuit 200, and a dimming module 122 coupled between the constant current module 121 and the external dimmer 300.

As shown in FIGS. 2A-2D, for example, the dimming module 122 may include a voltage dividing unit 1221 having a dimming input terminal Nin coupled with the external dimmer 300 and a sampling output terminal Nout coupled with the constant current module 121. The voltage dividing unit 1221 divides the voltage input from the external dimmer 300, to make the voltage input to the constant current module 121 meet the input safety threshold, thereby preventing damage to the constant current module 121 and thus the entire driving circuit 100.

Specifically, as shown in FIGS. 2A-2D, the voltage dividing unit 1221 includes a first resistor R16, a second resistor R17, and a third resistor R18. A first terminal of the first resistor R16 is coupled to the input sub-circuit 110, a second terminal of the first resistor R16 is coupled to a first terminal of the second resistor R17, a second terminal of the second resistor R17 is coupled to the sampling output terminal Nout and a first terminal of the third resistor R18, and a second terminal of the third resistor R18 is grounded in a post-stage manner.

The first resistor R16, the second resistor R17, and the third resistor R18 form a voltage dividing network. The input dimming voltage can be divided through the voltage dividing network following a magnitude adjustment with the external dimmer 300, thereby changing the voltage at the sampling output terminal Nout. Depending on the voltage, the constant current module 121 can accordingly adjust the signal duty cycle of a switch unit therein, thereby adjusting the output power supplied from the constant current module 121 to the light emitting circuit 200.

Furthermore and exemplarily, the dimming module 122 further includes a filtering unit 1222 coupled between the voltage dividing unit 1221 and the external dimmer 300.

Specifically, the dimming module 122 includes a positive input terminal D+ and a negative input terminal D− that are coupled with the external dimmer 300. The filtering unit 1222 includes a first capacitor C15 coupled between the positive input terminal D+ and the negative input terminal D−, a fourth resistor R20, a fifth resistor R21, a second capacitor C14, and a first diode D6 connected in series between the positive input terminal D+ and the negative input terminal D−. The sampling output terminal Nout is grounded via the second capacitor C14 in a post-stage manner, and the negative input terminal D− is grounded via the first diode D6 in a post-stage manner.

To further prevent the signal input from the external dimmer 300 to the dimming sub-circuit 120 from exceeding the safety threshold range of the dimming sub-circuit 120, as shown in FIGS. 2A-2D, a fuse F2 and a fuse F3 may be added at the positive input terminal D+ and the negative input terminal D−, respectively. In the case where the input signal is too large, the fuses F1 and F2 would be blown, thereby preventing the large signal from being input and damaging the dimming sub-circuit 120.

Exemplarily, the dimming module 122 further includes an anti-reverse diode D9 connected between the input terminal of the voltage dividing unit 1221 and the input sub-circuit 110. Specifically, the output terminal of the anti-reverse diode D9 is coupled to the voltage dividing network, and the input terminal of the anti-reverse diode D9 is coupled to the output terminal of the filtering unit 1222, thereby ensuring that the voltage input from the external dimmer 300 is input to the voltage dividing network, without flowing to other modules.

In an exemplary embodiment, the dimming module 122 may further include a voltage limiting unit 1223 configured to prevent the voltage input from the external dimmer 300 to the constant current module 121 from exceeding the threshold.

In practice, the input dimming voltage from the external dimmer is generally large, while the voltage input to the constant current module is small. In order to ensure that the voltage input to the constant current module meets the threshold range, a protection device such as a voltage limiting unit may be provided in the dimming module to prevent the devices from being damaged due to the large voltage input to the constant current module.

Specifically, the voltage limiting unit 1223 may include a Zener diode ZD1 and a Zener diode ZD3. The output terminal of the Zener diode ZD1 is coupled to the output terminal of the anti-reverse diode D9, and the input terminal of the Zener diode ZD1 is grounded in a post-stage manner. The output terminal of the Zener diode ZD3 is coupled to a connection point between the first resistor R16 and the second resistor R17, and the input terminal of the Zener diode ZD3 is grounded in a post-stage manner.

Exemplarily, the constant current module 121 includes a switch unit 1211, a control unit 1212, and an energy storage and freewheeling unit 1213 coupled between the control unit 1212 and the light emitting circuit 200. The control unit 1212 is configured to control on/off of the switch unit 1211, so as to control the output power of the constant current module 121.

Specifically, as shown in FIGS. 2A-2D, the control unit 1212 may be configured as a constant current chip U2, the model of which may be, for example, DIO8280L, in which the CF port is configured as a signal input port and coupled to the dimming module 122 to receive the dimming signal, the SW port is configured as an output port and coupled to the switch unit 1211, and the SENN port and the SEN port detect the sampling current through peripheral circuits, respectively.

Further, the CF port is coupled to the sampling output terminal Nout to receive the dimming signal. Resistors RS3, RS4, and RS5 are connected in parallel between the light emitting circuit 200 and the energy storage and freewheeling unit 1213. The SENN port and the SEN port are respectively connected to two ends of the parallel resistors, so that the sampling current can be calculated based on the voltage detected at the two ends of the parallel resistors and the resistance value of the parallel resistors.

Within the control unit 1212, the sampling current, the dimming signal and the current flowing through the switch unit 1211 are compared, and depending on the comparison result, the switch unit 1211 adjusts the power of the constant current module 121 to change the brightness of the light emitting circuit 200.

Specifically, when the voltage of the signal input port increases, the turn-on time of the switch unit 1211 increases, whereas when the voltage of the signal input port decreases, the turn-on time of the switch unit 1211 decreases.

In an exemplary embodiment, the switch unit 1211 includes a power MOS transistor integrated in the control unit 1212, wherein the source of the power MOS transistor is grounded, and the drain of the power MOS transistor is coupled to the energy storage and freewheeling unit 1213, to regulate the output power of the constant current module 121.

In an exemplary embodiment, as shown in FIGS. 2A-2D, the energy storage and freewheeling unit 1213 includes an energy storage inductor L2 and a freewheeling diode D5.

According to an exemplary embodiment of the present invention, the input sub-circuit 110 includes a filtering module 111 coupled to the mains, and a rectifier module 112 coupled between the filtering module 111 and the dimming sub-circuit 120. The filtering module 111 is configured to filter the mains signal, and the rectifier module 112 is configured to rectify the filtered mains signal.

Specifically, in an exemplary embodiment, as shown in FIGS. 2A-2D, the rectifier module 112 includes a bridge rectifying unit DB1, a third capacitor C2, and a varistor RV2. A first input terminal of the bridge rectifying unit DB1 is grounded in a pre-stage manner, and the output terminal is grounded in a pre-stage manner via the varistor RV2 and the third capacitor C2 that are connected in parallel.

In an exemplary embodiment, as shown in FIGS. 2A-2D, the filtering module 111 includes a sixth resistor R1, a fourth capacitor C1, and a filtering inductor L1. The filtering inductor L1 and the sixth resistor R1 are connected in parallel between a second input terminal of the bridge rectifying unit DB1 and the first terminal of the fourth capacitor C1, and a second terminal of the fourth capacitor C1 is coupled to a third input terminal of the bridge rectifying unit DB1.

In particular, the driving circuit has a neutral input terminal N and a live input terminal L respectively connected to the mains, and one of the input terminals, such as the live input terminal L as shown in FIGS. 2A-2D, is connected in series with a fuse F1, to prevent a too large signal from being input and damaging the driving circuit. Alternatively, an inductor LF1 and a varistor RV1 may be coupled between the neutral input terminal N and the live input terminal L.

Further, the input sub-circuit 110 may further include a voltage stabilizing module 113 coupled between the rectifier module 112 and the dimming sub-circuit 120. The voltage stabilizing module 113 is configured to stabilize the signal input to the dimming sub-circuit 120. In particular, as shown in FIGS. 2A-2D, the voltage stabilizing module 113 may be a constant voltage module, and configured as a constant voltage chip U1 in the model of DIO81054.

Figure 3:
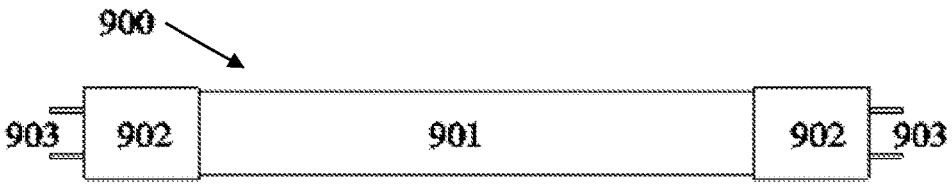
FIG. 3 schematically illustrates an LED lamp.

FIG. 3 illustrates a schematic diagram of a lighting apparatus according to an embodiment of the present invention. In an exemplary embodiment, the lighting apparatus 900 is an LED lamp. The LED lamp 900 includes a lamp body 901 and end caps 902 located at two ends of the lamp body 901. Each end cap 902 is provided with two pins 903 for connecting with an external power source. The lamp body 901 is provided with an LED light strip as the light emitting circuit and a driving circuit therein. The driving circuit converts the input external alternating current into a constant direct current and outputs the direct current to the LED light strip, so that the LED light bar emits light.

As will be understood by those skilled in the art, the term "coupled" includes not only a direct connection between electrical elements, but also various connection modes between electrical elements, such as direct and indirect electrical connections and magnetic couplings. Those skilled in the art will also recognize that the present invention is in no way limited to the exemplary embodiments described above. Instead, many modifications and variations are possible within the scope of the appended claims. For example, further components may be added to or removed from the described apparatus. Further embodiments may be within the scope of the invention. In addition, in the claim, the word "comprising" does not exclude other elements or steps. The simple fact that certain steps are recited in mutually different dependent claims does not mean that these steps cannot be combined.

What is claimed is:

1. A dimmable lighting apparatus, comprising a lamp body, and a driving circuit and a light emitting circuit in the lamp body, wherein the driving circuit is configured to drive the light emitting circuit to emit light, and the driving circuit includes an input sub-circuit coupled to a mains and a dimming sub-circuit coupled to an external dimmer, the input sub-circuit, and the light emitting circuit, and wherein the input sub-circuit is grounded in a pre-stage manner, and the dimming sub-circuit is grounded in a post-stage manner wherein the dimming sub-circuit comprises a constant current module coupled to the light emitting circuit, and a dimming module coupled between the constant current module and the external dimmer, and wherein the constant current module comprises a switch unit, a control unit, and an energy storage and free-wheeling unit coupled between the control unit and the light emitting circuit, wherein the control unit is configured to control on/off of the switch unit to control an output power of the constant current module.

2. The lighting apparatus according to claim 1, wherein the dimming module comprises a voltage dividing unit having a dimming input terminal coupled to the external dimmer, and a sampling output terminal coupled to the constant current module.

3. The lighting apparatus according to claim 2, wherein the voltage dividing unit comprises a first resistor, a second resistor, and a third resistor, wherein a first terminal of the first resistor is coupled to the input sub-circuit, a second terminal of the first resistor is coupled to a first terminal of the second resistor, a second terminal of the second resistor is coupled to the sampling output terminal and a first terminal of the third resistor, and a second terminal of the third resistor is grounded in a post-stage manner.

4. The lighting apparatus according to claim 3, wherein the dimming module further comprises a filtering unit coupled between the voltage dividing unit and the external dimmer.

5. The lighting apparatus according to claim 2, wherein the dimming module comprises a positive input terminal and a negative input terminal coupled to the external dimmer, the filtering unit comprises a first capacitor coupled between the positive input terminal and the negative input terminal, a fourth resistor, a fifth resistor, a second capacitor, and a first diode connected in series between the positive input terminal and the negative input terminal, wherein the sampling output terminal is grounded in a post-stage manner through the second capacitor, and the negative input terminal is grounded in a post-stage manner through the first diode.

6. The lighting apparatus according to claim 1, wherein the dimming module comprises a voltage limiting unit configured to prevent a voltage input from the external dimmer to the constant current module from exceeding a threshold.

7. The lighting apparatus according to claim 1, wherein the switch unit comprises a power MOS transistor being integrated in the control unit.

8. The lighting apparatus according to claim 1, wherein the input sub-circuit comprises a filtering module coupled to the mains and a rectifier module coupled between the filtering module and the dimming sub-circuit, wherein the filtering module is configured to filter a mains signal, and the rectifier module is configured to rectify the filtered mains signal.

9. The lighting apparatus according to claim 8, wherein the rectifier module comprises a bridge rectifying unit, a varistor and a third capacitor, wherein a first input terminal of the bridge rectifying unit is grounded in a pre-stage manner, an output terminal of the bridge rectifying unit is grounded in a pre-stage manner through the varistor and the third capacitor that are connected in parallel.

10. The lighting apparatus according to claim 9, wherein the filtering module comprises a sixth resistor, a fourth capacitor, and a filtering inductor, wherein the filtering inductor and the sixth resistor are connected in parallel between a second input terminal of the bridge rectifying unit and a first terminal of the fourth capacitor, and a second terminal of the fourth capacitor is coupled to a third input terminal of the bridge rectifying unit.

11. The lighting apparatus according to claim 8, wherein the input sub-circuit further comprises a voltage stabilizing module coupled between the rectifier module and the dimming sub-circuit, and the voltage stabilizing module is configured to stabilize a signal input to the dimming sub-circuit.

12. The lighting apparatus according to claim 1, wherein the lighting apparatus is an LED lamp.

13. The lighting apparatus according to claim 12, wherein the LED lamp further comprises end caps located at two ends of the lamp body, and each of the end caps is provided with pins.

* * * * *